US008099803B2

(12) United States Patent
Pesta

(10) Patent No.: US 8,099,803 B2
(45) Date of Patent: Jan. 24, 2012

(54) METHOD OF USING CLIPS FOR RETROFIT INSTALLATION OF A PORTABLE SWIMMING POOL BARRIER FENCE

(76) Inventor: LeeAnn Pesta, West Babylon, NY (US)

( * ) Notice: Subject to any disclaimer, the term of this patent is extended or adjusted under 35 U.S.C. 154(b) by 1050 days.

(21) Appl. No.: 12/004,823

(22) Filed: Dec. 22, 2007

(65) Prior Publication Data

US 2008/0141450 A1 Jun. 19, 2008

Related U.S. Application Data

(63) Continuation-in-part of application No. 11/158,859, filed on Jun. 22, 2005, now Pat. No. 7,389,573.

(51) Int. Cl.
*E04H 4/00* (2006.01)

(52) U.S. Cl. ..... 4/496; 4/504; 4/511

(58) Field of Classification Search ..... 256/53; 4/469, 504, 511, 496; 248/223.41; 52/712, 52/293.3, 285.3, 699, 704, 489.1, 714; 29/243.56; 403/DIG. 10; 24/542, 543, 290, 720
See application file for complete search history.

(56) References Cited

U.S. PATENT DOCUMENTS

| | | | | |
|---|---|---|---|---|
| 3,909,998 | A * | 10/1975 | Simpson et al. | 52/223.6 |
| 4,572,381 | A * | 2/1986 | Breakey et al. | 211/94.01 |
| 6,123,321 | A * | 9/2000 | Miller | 256/25 |
| 6,418,693 | B2 * | 7/2002 | Ballard | 52/589.1 |
| 2001/0025953 | A1 * | 10/2001 | Shepherd | 256/24 |
| 2002/0088968 | A1 * | 7/2002 | Bebendorf | 256/24 |
| 2003/0047660 | A1 * | 3/2003 | Gaunt et al. | 248/476 |
| 2004/0107491 | A1 * | 6/2004 | Publicover | 4/498 |

* cited by examiner

*Primary Examiner* — Gregory Huson
*Assistant Examiner* — Lauren Heitzer
(74) *Attorney, Agent, or Firm* — Alfred M. Walker; John F. Vodopia

(57) ABSTRACT

The installation and removal of a portable but sturdy pool barrier fence uses the hardware installed for attaching a safety pool cover during the pool use season. Multiple rectangular panel frames support a mesh fabric. Spaced anchors mounted in said deck adapted to support a cover or said fence when said cover is removed. The fence has rectangular sections formed by upper, lower and side frame members enclosing the fencing material. Each lower frame member in the fence sections has a centrally located rib extending longitudinally along a top surface thereof. Anchor clips, preferably Z-shaped clips, are located and attached to the deck at the anchors in the deck. Each of the anchor clips has a keyway for engaging a respective rib on the lower frame member of the rectangular fence section to secure the fence to the deck.

9 Claims, 7 Drawing Sheets

Fig. 8
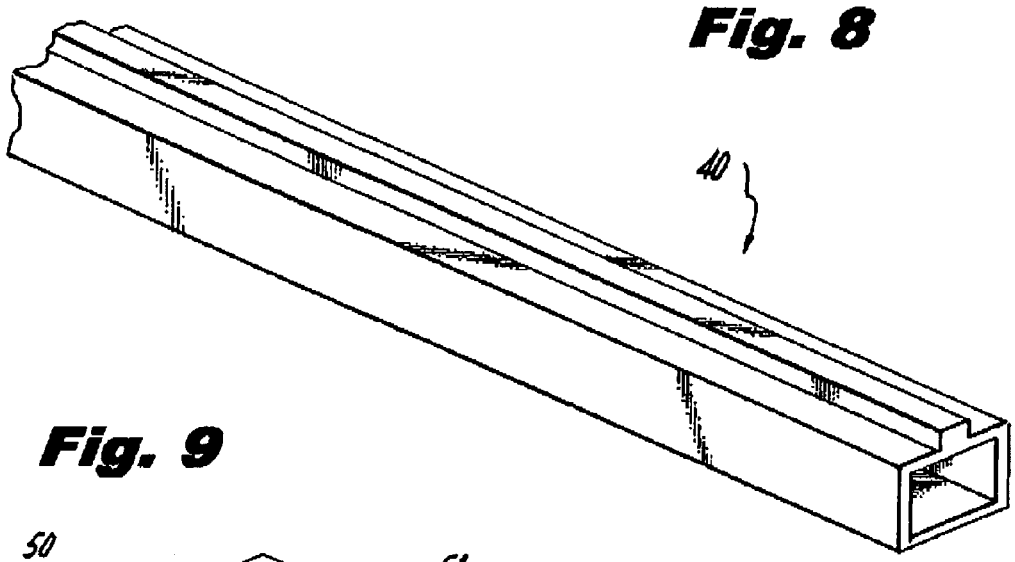
Fig. 9
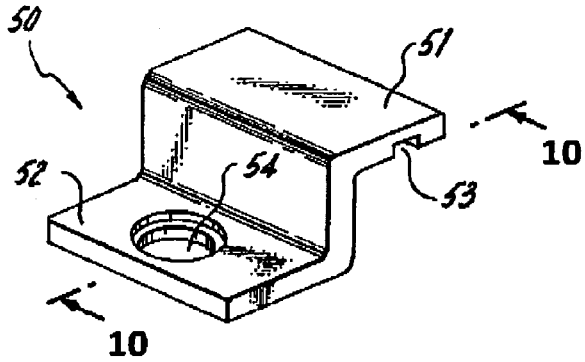
Fig. 10
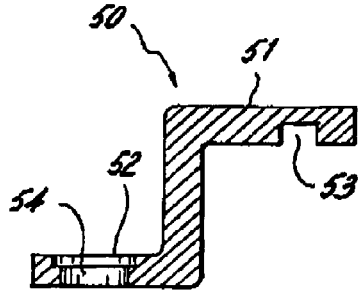
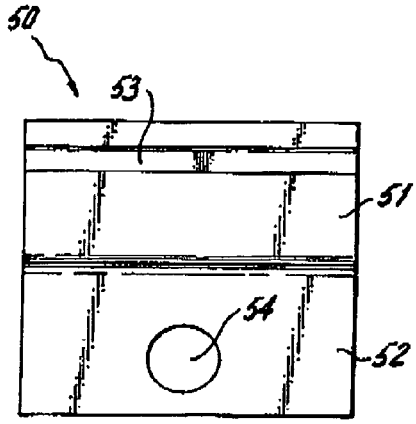
Fig. 11

METHOD OF USING CLIPS FOR RETROFIT INSTALLATION OF A PORTABLE SWIMMING POOL BARRIER FENCE

RELATED APPLICATIONS

This application is a continuation-in-part of application Ser. No. 11/158,859 filed Jun. 22, 2005 now U.S. Pat. No. 7,389,573, and claims priority under 35 U.S.C. 120 therefrom, These applications are incorporated by reference herein.

FIELD OF THE INVENTION

The present invention relates to a barrier fence which is designed to prevent babies, toddlers and small children up to about five years old from wandering dangerously close to the pool's edge.

BACKGROUND OF THE INVENTION

Although other pool barrier fences are available, they are typically not sturdy and are often unsightly with angled support poles and sagging barrier mesh fabric. The most troublesome aspect of the prior art fences is the need to bore new holes into the pool deck region for initial installation.

OBJECTS OF THE INVENTION

If a seasonal use analysis of swimming pools were considered, the off-season is typically characterized by the use of a safety pool cover. The in-use season where small children or babies and toddlers frequent the area is characterized (or should be) by the use of a barrier fence. In addition, it is very desirable to be able to conveniently remove the fence, store it, and reinstall it. This may be done several times during the in-use season to accommodate adult or teen-age pool parties in addition to the seasonal change dates. The convenience factor can become a crucial safety factor if one were to procrastinate re-installation merely due to the effort involved.

Other objects may become apparent from the following description of the present invention.

SUMMARY OF THE INVENTION

In keeping with these objects and others which may become apparent, the installation and removal of a portable but sturdy pool barrier fence of the present invention takes advantage of the seasonal use analysis by using the hardware installed for attaching a safety pool cover for also attaching a portable barrier fence.

The portable pool barrier fence itself is configured of multiple units such as rectangular panels, each fence unit with a sturdy rigid aluminum or plastic frame supporting a stretched poly-coated open weave mesh fabric. In particular, each pool barrier fence panel unit has a lower horizontal frame member, with a series of slots designed to accommodate the same anchor screw which is used to attach the pool cover spring coupling during the off-season. In this manner, a fence panel unit is attached to the pool deck surface using the same hardware, namely the pre-installed deck anchor and the screw, as used for the pool cover.

Sections of fencing panel units are attached together using bi-fold hinges, which permit 360 degree rotation of one panel unit relative to an adjacent one. This allows storage of the barrier fence as a dense rectangular three dimensional unit (like a cube) by folding the panel units upon each other accordion-like. This folding flexibility also makes it easy to follow straight, oval or round contours, to make right angle corners, and to easily avoid obstacles such as roof supports or diving boards.

Additionally, not every fence panel unit need be attached to the deck surface to maintain structural integrity. The many slotted holes on the bottom frame sections offer many opportunities to find one to accommodate the attachment screw over a pool cover anchor while maintaining almost ideal contour or straight alignment of pool fence panel units. Obviously, an extra pool cover anchor to accommodate a special fence anchor location can be installed if needed. Any frame unit retrofitted with a latch and hinges serves as a gate. In addition, a gate includes a single frame section unit with a magnetic latch and self closing hinges.

The method of retrofitting the portable pool barrier fence to existing swimming pool deck hardware includes the following steps.

First, the swimming pool cover is removed from the swimming pool. Then the pool cover is released from being secured in place by a plurality of spaced anchors on a pool deck, which surrounds the pool. Preferably, each anchor includes a socket, such as a solid brass cylinder, fully embedded in the swimming pool deck, wherein a fastener, such as a brass screw, is threaded into the anchor socket, flush with the top surface of the anchor and deck.

Then the fastener screws are removed from a number of the pool cover anchors. Also, preferably, a knurled shoulder is formed on an upper end of each anchor embedded within the swimming pool deck, to prevent rotation of the anchor.

Thereafter, panel units of the pool barrier fence are placed upright on the deck, whereon each panel unit is a rectangular frame with bottom, top and side frame members enclosing fencing material, such as a flexible mesh.

The fence units are then arranged as a preassembled 4-section unit, so that the bottom frame member of each preassembled fence unit spans at least two of the pool anchors.

Then the fasteners, such as the brass screws, are preferably reinserted through the brass washers, then through the slots in the bottom frame member, then into the brass anchor casing, finally, securing the fence panel unit in place on the swimming pool deck. The washers preferably have truncated sides to fit on the bottom frame members of the respective fence units.

Additional fence units are attached by connecting new units via the hinges to the prior anchored fence units and secured in place, as previously described. These additional units of fence are added to fence units which are already mounted on the deck, until the swimming pool is fully enclosed by the assembled pool barrier fence.

Moreover, to accommodate different angles of orientation of the fence units, the fence units are swivelly attached to each other, using the bi-fold hinges.

Finally, at the end of the swimming season, the fence panel units are removed from the pool deck, and are foldable at the bi-fold hinges for convenient storage. Then the pool cover is reinstalled over the swimming pool for the ensuing non-swimming winter season.

In an alternate embodiment, the attachment method still uses the pre-installed fasteners of the pool cover, however the bottom frame member of the barrier fence panels is modified and separate anchor clips are used to secure the bottom frame members to the pool deck. While the side and top frame members of the fence panels are preferably hollow square fiberglass (or aluminum) tubing as in the previous embodiment, the bottom frame members are also the same crossectional shape except for an added centrally located rib along the top surface of the tubing. The anchor clips are preferably a fiberglass part including a top flange and a bottom flange extending in opposite directions connected by a vertical wall of a height equal to the height of the bottom fence frame member. The top flange has a strategically placed groove on its bottom surface which forms a keyway capturing the rib on the top of the bottom frame member when installed. The bottom flange has a centrally located countersunk hole which accepts the brass mounting screw. In this manner, no slots are required in the bottom frame member of the fence (increasing rigidity), and an anchor can be installed anywhere along the bottom frame member thereby eliminating the registration requirement between the location of slots and brass pool cover anchors embedded in the pool deck.

BRIEF DESCRIPTION OF THE DRAWINGS

The present invention can best be understood in connection with the accompanying drawings. It is noted that the invention is not limited to the precise embodiments shown in drawings, in which:

FIG. 8 is a perspective view of a section of bottom frame member of barrier fence showing the rib extending from the top surface as required by the alternate embodiment;

FIG. 9 is a perspective view an anchor clip of the alternate embodiment;

FIG. 10 is a side cross-sectional view of an anchor clip;

FIG. 11 is a top plan view of an anchor clip, and

DETAILED DESCRIPTION OF THE INVENTION

The present invention has broad applications to many technical fields for a variety of articles. For illustrative purposes only, a preferred mode for carrying out the invention is described herein, wherein the installation and removal of a portable but sturdy pool barrier fence of the present invention takes advantage of the seasonal use analysis, by using the hardware installed for attaching a safety pool cover, for also attaching a portable pool barrier fence.

Figure 1:
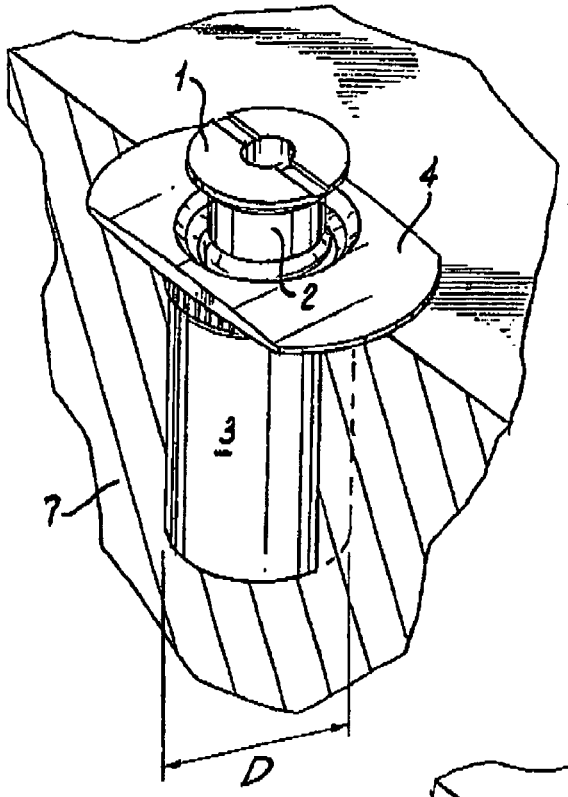
Fig. 1 (Prior Art)
FIG. 1 is a perspective view of a prior art installed pool anchor with a washer and a screw in its pool cover configuration; this prior art figure shows the deck in cross section.

FIG. 1 shows a side view of the preferred type of prior-art pool cover anchor 3 as installed in pool deck 7. Anchor 3 is preferably a heavy-walled brass cylinder with diameter D of 0.75" (19 mm), with a closed bottom and a top ring with a straight knurl as an anti-rotation feature. It has a central threaded hole (not shown) to accept pool cover screw 1. Screw 1 is a large brass screw with a flat head and smooth shank 2 which accepts the attachment ring of a pool cover. A contoured heavy brass washer 4 with a countersink hole is also shown. During seasonal use, the pool cover is removed.

Figure 2:
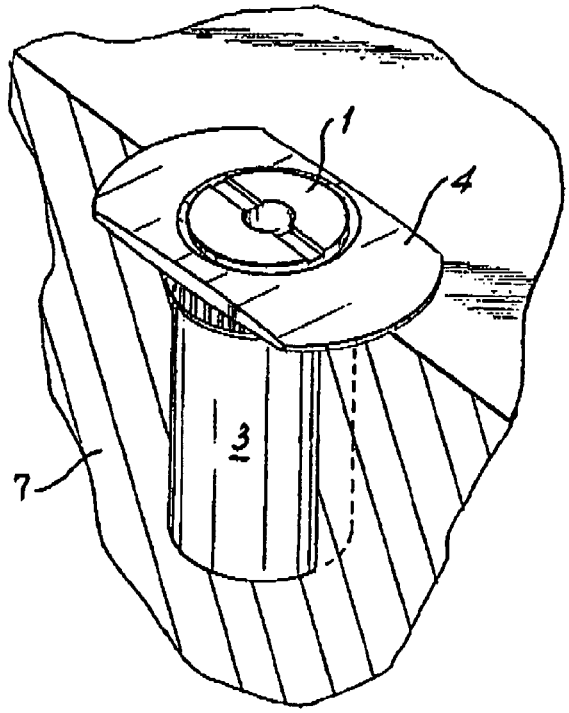
Fig. 2 (Prior Art)
FIG. 2 is a perspective view of the installed prior art pool anchor of FIG. 1 with the screw screwed down into the anchor.

FIG. 2 shows that to avoid debris from entering the hole in anchor 3 and to provide a convenient storage for screw 1, it is just screwed down into anchor 3 to seat into the countersink hole in contoured washer 4. Washer 4 provides a non-obtrusive surface not injurious to bare feet.

Figure 3:
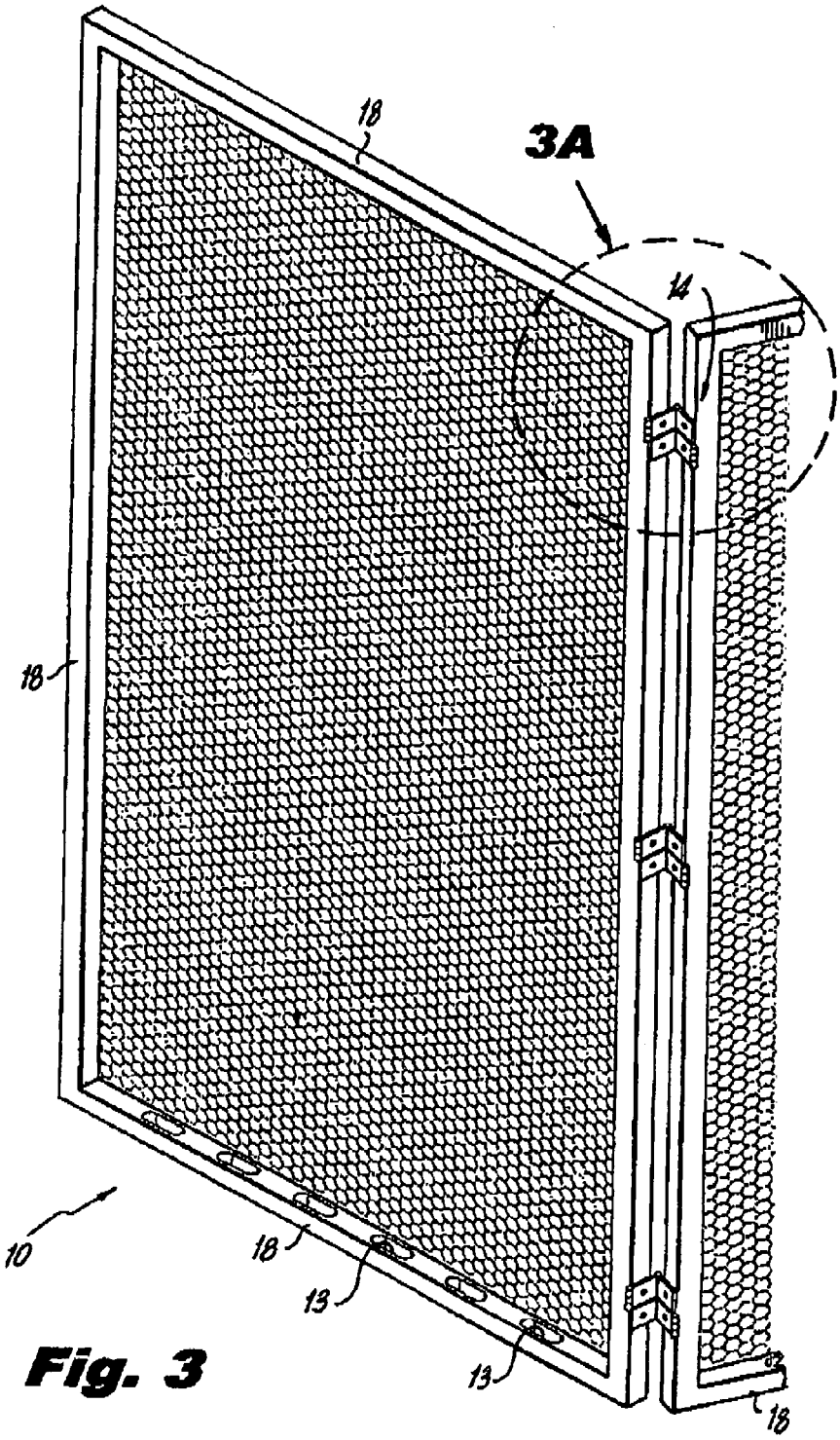
FIG. 3 is a perspective view of a portable pool barrier fence frame of a unit of this invention.
Figure 3A:
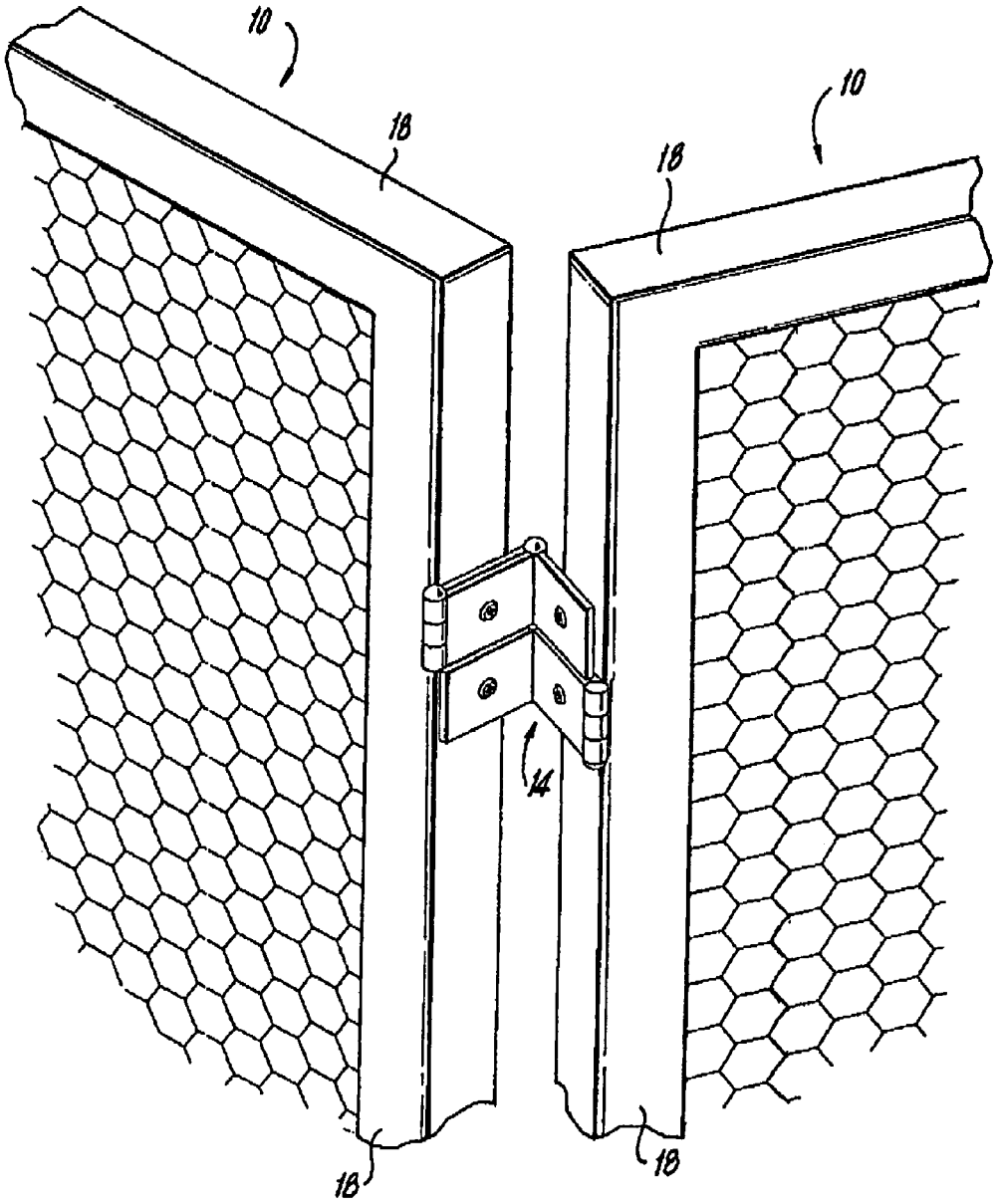
FIG. 3A is a close-up perspective view of a portable pool barrier fence frame section of this invention.

FIG. 3 shows a single fence unit 10 of the pool barrier fence of the present invention, with rigid frame 11 and stretched poly-coated open weave panel 12. Bottom frame member 18 with an array of slotted holes 13 is used to attach the fence to deck 7. One attached three segment bi-fold hinge 14 is shown on the right vertical frame 11 member. Hinge 14 has fastener access hole 16 in the center segment, and fastener attachment hole 15 which would be used to attach to an adjacent unit section 10. Unless it is an end unit 10, the left vertical frame member 11 will also have two bi-fold hinges 14 attached.

Figure 4:
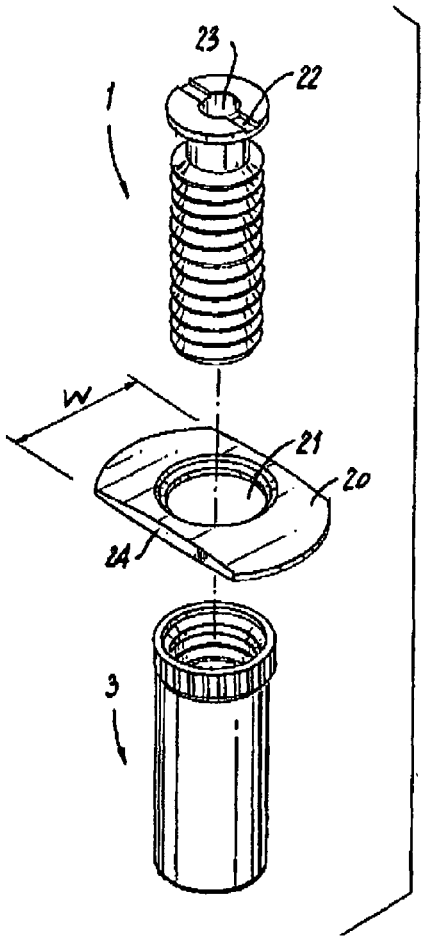
FIG. 4 is an exploded perspective view of a prior art pool anchor screw and a contoured washer of this invention.

FIG. 4 shows anchor screw 1 with a flat head having both a driving slot 22 as well as hex wrench recess 23. Oval type contoured washer 20 has truncated sides to width W, the depth of bottom frame member 18. Washer 20 is heavy brass with a countersunk central hole and smooth contours.

Figure 5:
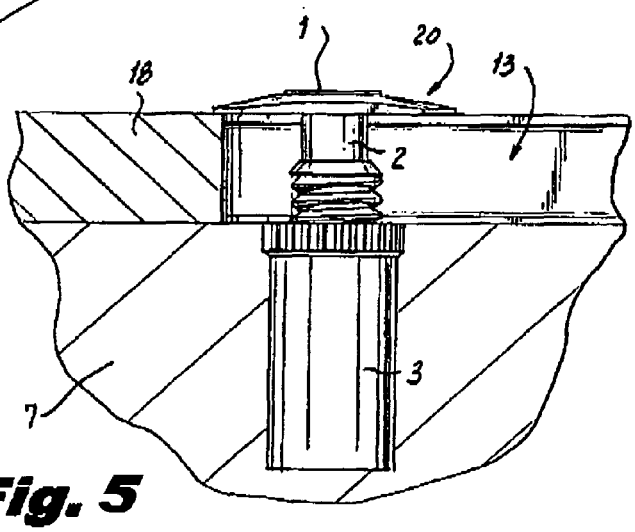
FIG. 5 is a side view detail of the bottom frame member of a panel unit of the pool barrier fence of this invention, shown in the vicinity of a slotted hole, along the long axis centerline, showing the installation of the anchor screw in the pre-installed anchor.

FIG. 5 is a side cross section illustration of the attachment of frame member 18 to deck 7 via pre-existing anchor 3, screw 1 and washer 20. Screw 1 can penetrate slotted hole 13 anywhere along its length and exert holding force on bottom frame member 18, via washer 20 bridging the entire depth of frame member 18, including the inner and outer edges of slotted hole 13. This makes it easier to line up an anchor 3 with the fence in the desired orientation.

Figure 6:
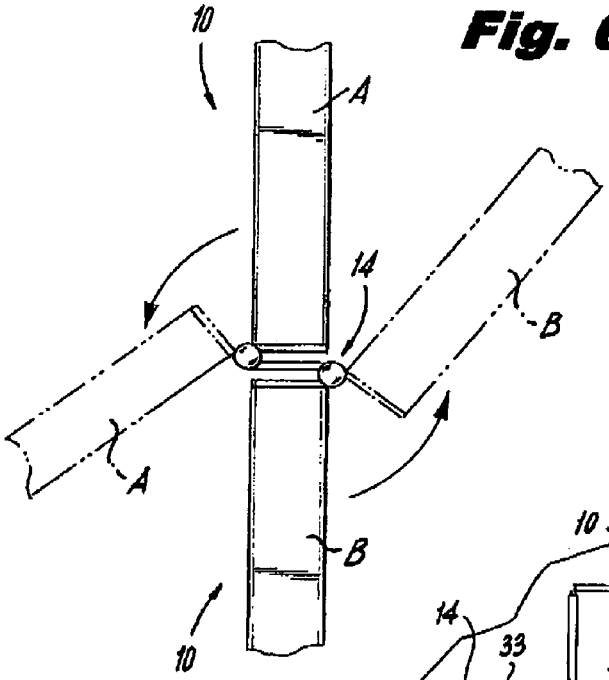
FIG. 6 is a top plan view of two fence panel units attached via a three segment bi-fold hinge, illustrating the range of motion permitted by the arrangement of the portable pool barrier fence of this invention.

FIG. 6 shows the attachment of bi-fold hinge 14 to two adjacent fence sections 10. It is noted that the two fence sections 10 can swing while still being attached. In particular, if fence section "A" is held in its original position, fence section "B" can be swung adjacent to it. This means that a whole string of attached fence sections can be folded, like an accordion to create a compact storage configuration.

Figure 7:
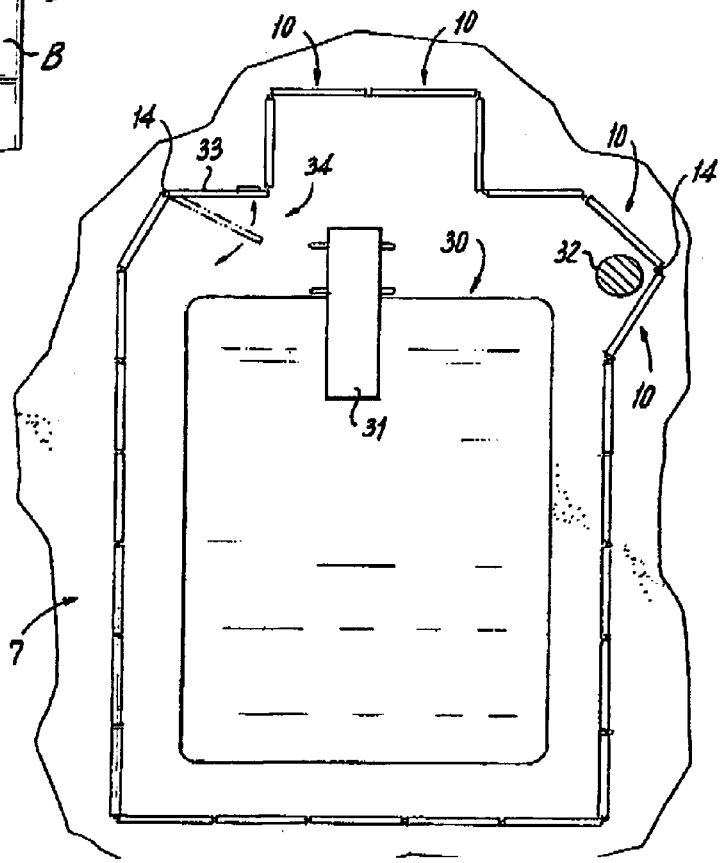
FIG. 7 is a top view of a typical pool encircled by the portable barrier fence of this invention.

FIG. 7 shows pool 30 encircled by many attached sections 10 of the portable barrier fence of this invention. It is with considerable ease that the corners are made and obstacles such as column 32 or diving board 31 are avoided.

In an alternate embodiment a different bottom frame member is used on all barrier fence panels.

For example, FIG. 8 shows a section of bottom railing 40 with perpendicular cut end 41 revealing the crossection. It is preferably a square hollow tube preferably of fiberglass with a centrally located rib 43 on top of the top surface 42.

FIGS. 9-11 show various views of anchor clip 50 which are used to attach bottom railing 40 to the pool deck. In a preferred embodiment, clip 50 has a "Z-clip" configuration. Clip 50 has top flange 51 with longitudinal groove 53 on its bottom surface. Bottom flange 52 preferably has a large centrally located countersunk hole 54 sized to accept fasteners, such as screws 1, which are also used to attach a pool cover in the off-season.

Figure 12:
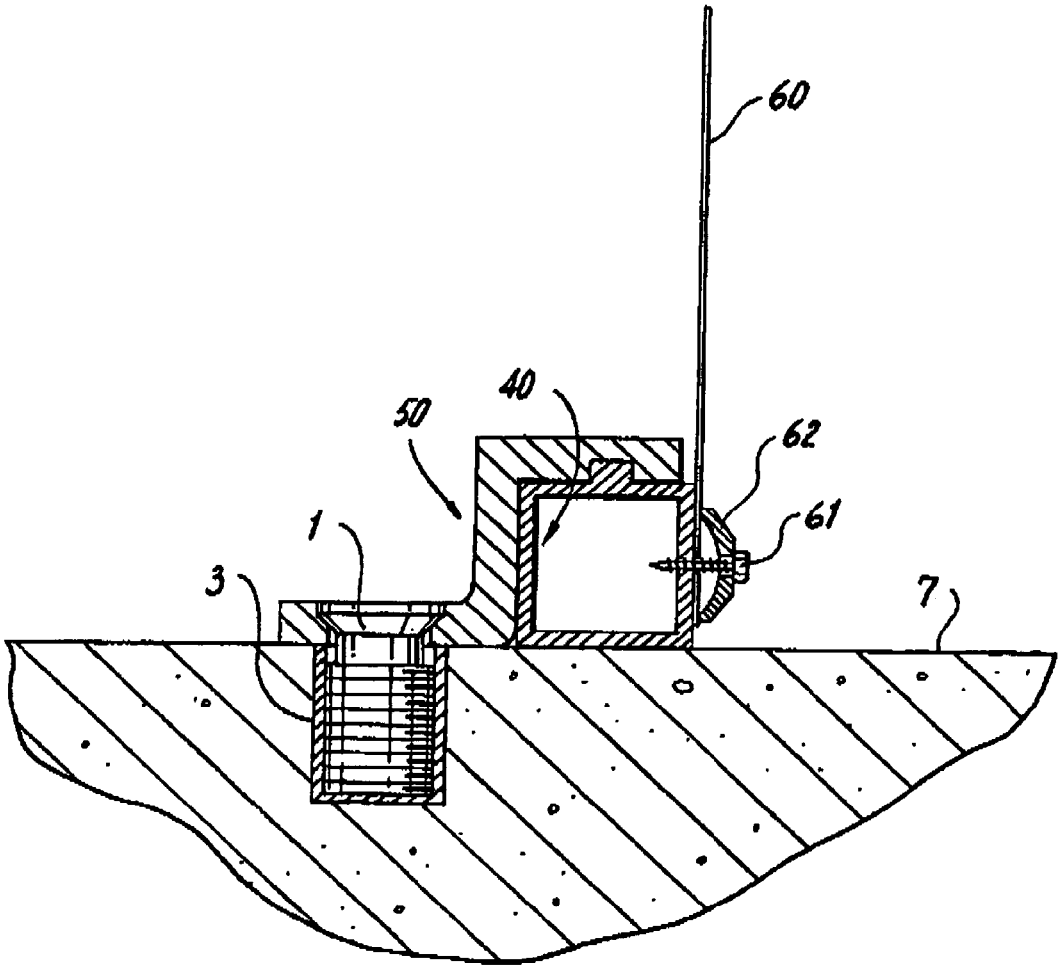
FIG. 12 is a side crossectional view of an assembly detail of the alternate embodiment.

The crossectional assembly detail of FIG. 12 shows portions of a barrier fence panel, including bottom frame member 40, with flexible mesh panel 60, attached via screw 62 through cove moulding 61. Anchor clip 50 is rigidly attached to pool deck 7 via fastener 1, such as a screw, inside hole 54 being threaded into pre-installed brass deck anchor 3. Bottom frame member 40 is securely attached to pool deck 7 by anchor 50, which has locked rib 43 within groove 53.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended claims.

I claim:

1. The combination of a barrier fence and a swimming pool comprising:

said swimming pool being surrounded by a deck;

spaced anchors mounted in said deck, each anchor having a central threaded hole adapted to receive a threaded screw;

said fence having rectangular sections formed by upper, lower and side frame members enclosing fencing material;

a hollow, extended bottom railing on said deck, said railing being rectangular in cross section with a bottom wall on said deck, vertical side walls, and a horizontally extending top wall having a centrally located rib extending a full length of said railing;

an anchor clip located at each anchor on;

means attaching each of said anchor clips to an anchor on said deck;

each of said anchor clips having a keyway for engaging said rib on said lower frame member for seeming said railing to said deck; and screw members for attaching the lower side frame member of each said fence section to a side wall of said railing, thereby securing said fence to said deck said anchor clips being configured to allow said anchor clips to be released from said anchors on said deck without detaching said lower side frame member from said side wall of said railing].

2. The combination of claim 1 in which each anchor clip comprises top and bottom parallel flanges joined by and extending in opposite directions from top and bottom edges, respectively, of a vertical wall forming a Z-shaped configuration with said keyway located in a bottom surface of said top flange and said attaching means is in said bottom flange whereby said keyway is offset from said attaching means.

3. The combination of claim 2 in which said attaching means comprises said bottom flange having has a hole aligned with an anchor in said deck, and a fastener passing through said hole engaged with said anchor in said deck.

4. The combination of claim 3 in which said fastener is a screw.

5. The combination of claim 3 in which said hole is countersunk.

6. The combination of claim 1 wherein said railing is fiberglass.

7. The combination of claim 1 wherein said railing is metal.

8. The combination of claim 7 wherein said railing is aluminum.

9. The combination of claim 1 wherein said said fence sections are connected together by bi-fold hinges, whereby any section is adapted to function as an entranceway to said pool.

* * * * *